US007409728B2

(12) United States Patent
Harry

(10) Patent No.: US 7,409,728 B2
(45) Date of Patent: Aug. 12, 2008

(54) ADJUSTABLE SUITMATE MOCK BLOUSE

(76) Inventor: Inez Rucker Harry, 5220 Torrington Cir., Baltimore, MD (US) 21237

( * ) Notice: Subject to any disclaimer, the term of this patent is extended or adjusted under 35 U.S.C. 154(b) by 152 days.

(21) Appl. No.: 11/451,531

(22) Filed: Jun. 12, 2006

(65) Prior Publication Data

US 2006/0277648 A1 Dec. 14, 2006

Related U.S. Application Data

(60) Provisional application No. 60/689,291, filed on Jun. 11, 2005.

(51) Int. Cl.
*A41D 1/18* (2006.01)
*A41D 27/18* (2006.01)

(52) U.S. Cl. ..... 2/106; 450/33

(58) Field of Classification Search ..... 450/1, 450/28, 30, 31–33, 80; 2/69, 67, 102–106, 2/109, 73, 115, 144, 145
See application file for complete search history.

(56) References Cited

U.S. PATENT DOCUMENTS 731,759 A * 6/1903 Dieter ..... 2/48
770,752 A * 9/1904 Hull ..... 2/54
2,567,524 A * 9/1951 Morganti ..... 2/48
2,700,767 A * 2/1955 Groocock et al. ..... 450/30
2,707,786 A * 5/1955 Stoner ..... 2/119
6,205,585 B1 * 3/2001 Capparelli ..... 2/106
6,550,067 B2 * 4/2003 Force ..... 2/104
6,935,921 B1 * 8/2005 Eudenbach et al. ..... 450/54
7,188,372 B2 * 3/2007 Stockard ..... 2/104

OTHER PUBLICATIONS

Gershman, M.D; Maurice; Journal of the American Medical Association, vol. 168 No. 7. Oct. 18, 1958.*

* cited by examiner

*Primary Examiner*—Gloria Hale
(74) *Attorney, Agent, or Firm*—Ober/Kaler; Royal W. Craig

(57) ABSTRACT

A "SuiteMate" mock blouse comprising a panel of decorative fabric that spans the chest area and which attaches at its upper corners to a user's bra straps by hook and loop fastener® attachments or fabric clamps, or to the skin by self-adhesive skin attachments. The mock blouse is secured at the lower corners around the upper waist by tie-strings. The mock blouse minimally covers the body in the chest area and ensures much greater breathability and comfort. The convenient attachments and tie-strings hold the mock blouse securely in place, and allow more convenient no-fuss application.

4 Claims, 3 Drawing Sheets

ADJUSTABLE SUITMATE MOCK BLOUSE

CROSS-REFERENCE TO RELATED APPLICATIONS

The present application derives priority from provisional patent application No. 60/689,291, filed Jun. 11, 2005.

BACKGROUND OF THE INVENTION

1. Field of the Invention

The present invention relates to ladies garments and, more particularly, to a mock blouse for more comfort, convenience, and economy of wear.

2. Description of the Background

Blouses are a basic clothing item and add versatility to one's wardrobe. A simple change of blouse can give a skirt, suit or pair of slacks a completely new look. There are a variety of conventional blouses including button-up shirts, halter-tops, and the like. These may be made of silk, cotton, Rayon, Polyester or the like. Typically, the design of a blouse is matched to the style of the garment with which it will be worn. A casual design would be suitable for casual wear, a tailored design for a suit blouse, and a dressy design for special occasion wear. Design may include the use of trims and buttons. Unfortunately, quality silk halter-top (or camisole) blouses are becoming extremely expensive, upward of $60-70 per. It becomes a costly proposition to buy a silk halter-top blouse for each suit in one's closet. Moreover, silk halter-top blouses can be very uncomfortable as they provide very little venting. Most silk halter-top blouses are essentially a close-fitting shirt to be worn beneath a suit jacket, and silk is not a breathable fabric. It would be greatly advantageous to provide a mock blouse for greater economy, more comfort, and ease of wearing.

SUMMARY OF THE INVENTION

It is, therefore, the primary object of the present invention to provide a mock blouse that can be manufactured at low cost for greater economy.

It is another object to provide a mock blouse that minimally covers the body only in the desired areas for greater breathability and comfort.

It is still another object to provide a mock blouse that is worn securely beneath a suit jacket by ready attachment to the waist via a tie-string, and to the bra via reclosable hook and loop fastener® or clamp attachments, thereby facilitating more convenient no-fuss application.

These and other objects are accomplished by a "SuiteMate" mock blouse comprising a panel of decorative fabric that spans the chest area and which attaches at its upper corners to a user's bra straps by hook and loop fastener® or clamp attachments, and which is secured at the lower corners around the upper waist by tie-strings. The mock blouse may be adorned along its upper periphery by a strip of trim, tassels or other decorations to give a more elegant appearance. Since the material costs of the mock blouse are greatly reduced in comparison to full body blouses they can be manufactured at low cost for greater economy, and most wearers can afford a greater variety in their wardrobe. Moreover, the mock blouse only minimally covers the body in the chest area and ensures much greater breathability and comfort. The convenient hook and loop fastener® or clamp bra attachments and tie-strings hold the mock blouse securely in place, and allow more convenient no-fuss application.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The present invention is a mock blouse for more comfort, convenience, and economy of wear.

Figure 1:
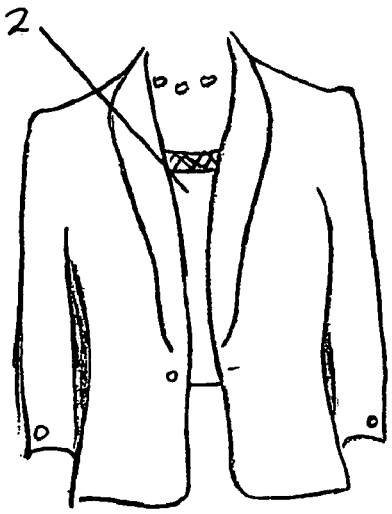
FIG. 1 shows a "SuiteMate" mock blouse 2 worn beneath a conventional business jacket.

FIG. 1 shows the "suitemate" mock blouse 2 according to the present invention being worn beneath a conventional business jacket. Clearly, the mock blouse 2 appears as an ordinary camisole or halter-top blouse, and yet provides the advantages to be described.

Figure 2:
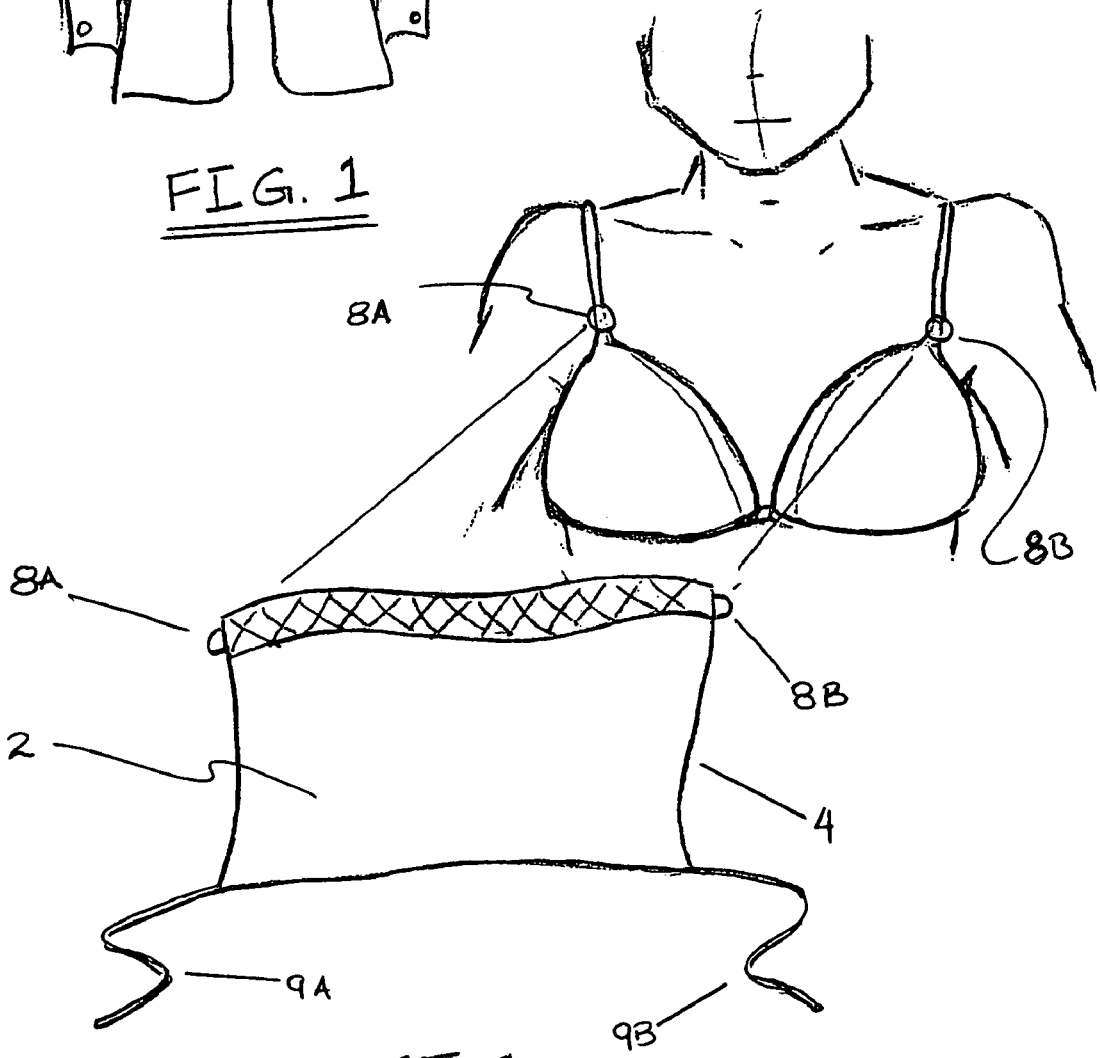
FIG. 2 is an application drawing of the mock blouse 2 of FIG. 1.
Figure 3:
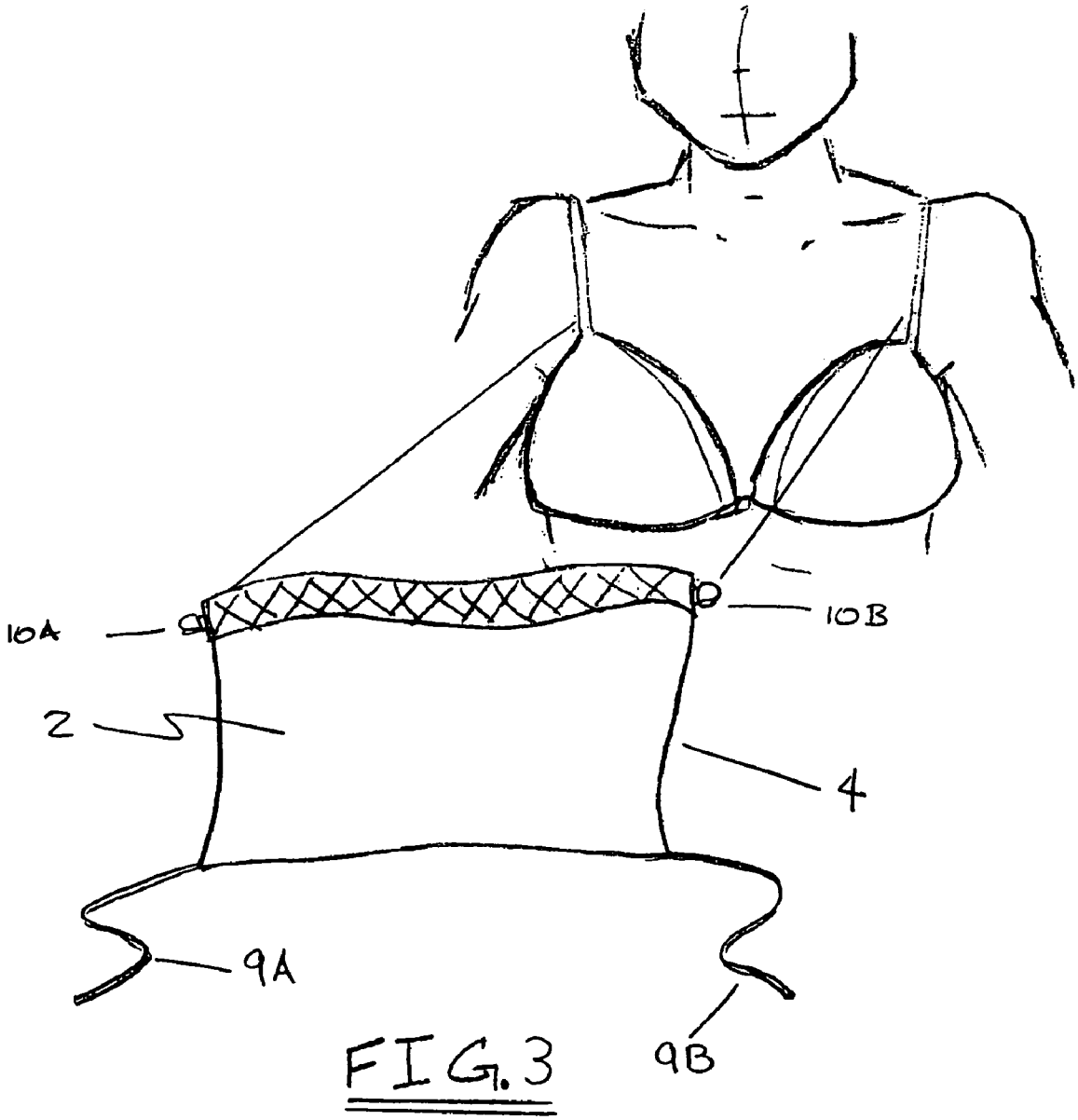
FIG. 3 is an application drawing of the mock bloods 2 of FIG. 1 depicting fabric clamps 10A & 10B to affix the mock blouse 2 to the brassiere of the user.
Figure 4:
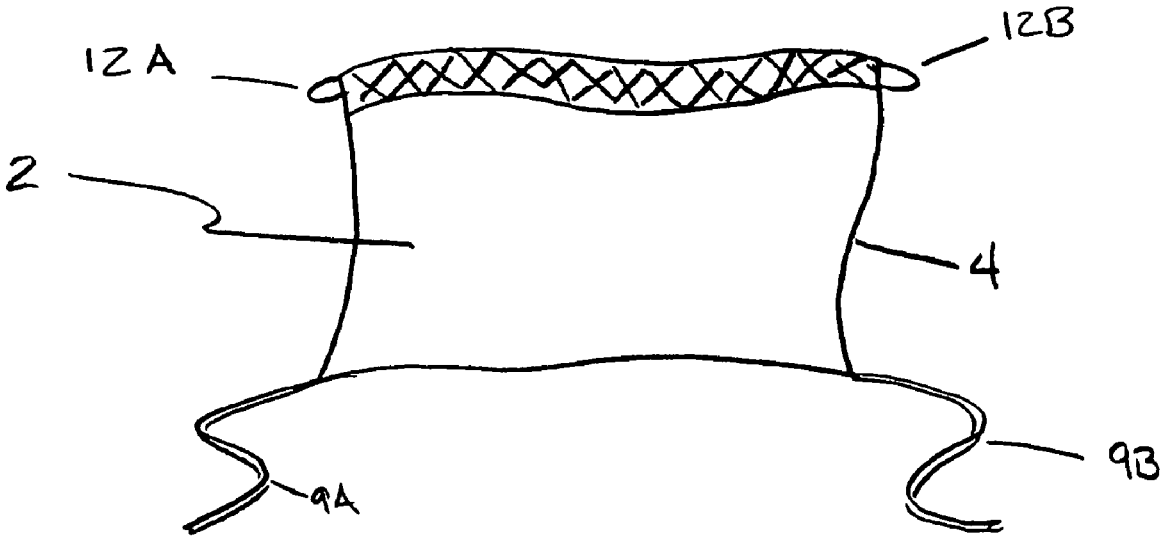
FIG. 4 is an application of drawing of the mock blouse 2 of FIG. 1 depicting self adhering pads 12A & 12B to affix the mock blouse 2 to the brassiere of the user.

FIG. 2 is an application drawing of the mock blouse 2 of FIG. 1. The mock blouse 2 generally comprises a substantially rectangular panel of decorative fabric 4 dimensioned to substantially span the chest area at the sternum. As seen in FIG. 1 the fabric panel 4 is patterned with vertical dimensions suited for covering the stomach area, in which case it comes across the stomach to meet the skirt or pants. Such dimensions are best suited to be worn with an open jacket as it will cover the stomach. However, the vertical dimensions may be varied as desired, and as seen in FIG. 2 (described below) the fabric panel 4 may be shorter, terminating just below the chest. Shorter vertical dimensions are better suited to be worn with a closed jacket as it will not cover the stomach.

The fabric panel 4 may be adorned along its upper periphery with trim, such as tassels, buttons, lace, or the like, as desired. The fabric panel 4 may be equipped with hook or loop attachment pads 8A & 8B (such as hook and loop fastener®) at both its upper corners for attachment to a user's bra straps, fabric clamps 10A & 10B at both its upper corners for attachment to a user's bra straps, or self-adhesive skin attachable pads 12A & 12B at both its upper corners for attachment directly to the skin in the same area. If designed for bra attachment using hook and loop pads 8A & 8B, mating pads must be applied to the bra straps as indicated at right in FIG. 2. If designed for bra attachment using fabric clamps 10A & 10B, conventional fabric clamps such as used on clip-on suspenders may be used.

The fabric panel 4 is equipped at its lower corners with opposing tie-strings 9A & 9B for tying around the upper waist area. The combination of upper hook and loop pads 10A & 10B, fabric clamps 10A & 10B, or self-adhesive attachments 12A & 12B and lower tie string attachments 9A & 9B ensure a very secure fit and dependable worry-free adhesion. In use, the wearer simply dons a bra (if necessary, with mating hook and loop fastener attachment pads pre-applied), holds the mock blouse 2 up across the chest, attaches the attachment pads 8A & 8B, clamps 10A & 10B or self-adhesive pads 12A & 12B as indicated, and ties the tie string attachments 9A & 9B around the upper waist. A jacket is then worn overtop, giving the full-blouse appearance with open jacket as in FIG. 1, or a full-blouse appearance with closed jacket as in FIG. 2. Since the material costs of the mock blouse 2 are much less than full body blouses they can be manufactured at low cost for greater economy, and most wearers can afford a greater variety in their wardrobe. Moreover, the mock blouse 2 only minimally covers the body in the chest area and ensures much greater breathability and comfort. The convenient hook and loop fastener® bra attachments 8A & 8B (or alternate fabric clamps or skin adhesive) and tie-strings 9A & 9B hold the mock blouse securely in place, and allow for simple no-fuss application.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A mock blouse for wearing under a conventional business jacket to present an appearance of a full blouse, comprising:

a rectangular fabric panel dimensioned to substantially span a user's chest area at their sternum and including an upper periphery bounded by a right upper corner and a left upper corner, and a lower periphery bounded by a right lower corner and a left lower corner;

a pair of attachment means attached to said right and left upper corners for attaching said upper corners to a pair of bra straps for simple no-fuss application; and a pair of tie-strings connected to said right and left lower corners for tying said tie-strings around a user's waist, whereby said mock blouse only covers the user's body in the chest area to ensure greater breathability and comfort.

2. A mock blouse according to claim 1, wherein said pair of attachment means is conventional fabric clamps.

3. A mock blouse for wearing under a conventional business jacket to present an appearance of a full blouse comprising:

a rectangular fabric panel dimensioned to substantially span a user's chest area at their sternum and including an upper periphery bounded by a right upper corner and a left upper corner, and a lower periphery bounded by a right lower corner and a left lower corner;

a pair of self-adhesive skin attachable pads, one each attached to said right and left upper corners, respectively, for attaching said upper corners directly to a user's skin at the outside left and right ends of the user's clavicle at the shoulder, for simple no-fuss application; and a pair of tie-strings connected to said right and left lower corners for tying said tie-strings around a user's waist, whereby said mock blouse only covers the user's body in the chest area to ensure greater breathability and comfort.

4. A mock blouse for wearing under a conventional business jacket to present an appearance of a full blouse comprising:

a rectangular fabric panel dimensioned to substantially span a user's chest area at their sternum and including an upper periphery bounded by a right upper corner and a left upper corner, and a lower periphery bounded by a right lower corner and a left lower corner;

two sets of complimentary hook and loop fastener pads attached, one each, to said right and said left upper corners;

a bra having right and left bra straps, wherein one pad of each said set of complimentary hook and loop fastener pads is attached to said straps for mating with said complimentary hook and loop pad, for simple no-fuss application; and a pair of tie-strings connected to said right and left lower corners for tying said tie-strings around a user's waist, whereby said mock blouse only covers the user's body in the chest area to ensure greater breathability and comfort.

* * * * *